United States Patent [19]

Baggaley

[11] 4,015,885

[45] Apr. 5, 1977

[54] DISPENSING AND DISPLAY DEVICE

[75] Inventor: Jon Clemens Baggaley, Hamilton, Canada

[73] Assignee: Tonecraft Limited, Toronto, Canada

[22] Filed: Mar. 1, 1976

[21] Appl. No.: 662,957

[52] U.S. Cl. ..... 312/42; 312/45; 211/49 D

[51] Int. Cl.[2] ..... A47F 7/00; B65H 19/00

[58] Field of Search ..... 312/42, 45; 211/49 D

[56] References Cited

UNITED STATES PATENTS

| | | | |
|---|---|---|---|
| 1,023,116 | 4/1912 | Bailey | 312/45 |
| 1,117,148 | 11/1914 | Amberg et al. | 312/45 |
| 2,119,700 | 6/1938 | Burgess | 312/45 |
| 2,160,102 | 5/1939 | Hull | 211/49 D |
| 3,008,584 | 11/1961 | Carson | 211/49 D |
| 3,055,293 | 9/1962 | Lariccia | 312/45 |
| 3,152,697 | 10/1964 | Berman et al. | 211/49 D |
| 3,157,445 | 11/1964 | Aversa | 312/45 |
| 3,809,448 | 5/1974 | Rakaska | 312/45 |

FOREIGN PATENTS OR APPLICATIONS

| | | | |
|---|---|---|---|
| 1,267,186 | 1961 | France | 211/49 D |
| 1,297,232 | 1962 | France | 211/49 D |
| 2,303,423 | 1972 | Germany | 312/45 |

*Primary Examiner*—Robert L. Wolfe
*Assistant Examiner*—Victor N. Sakran
*Attorney, Agent, or Firm*—Fetherstonhaugh & Co.

[57] ABSTRACT

In a display and storage device for rolls of decorative sheet material, a body, a storage rack in said body adapted to support a single file column of rolls of decorative sheet material with their roll axes parallel and horizontal, said body having a front display face that substantially conceals said storage rack, said rack having a depth greater than the depth but less than twice the depth of a roll of decorative material to be contained thereby whereby to support said rolls in a single file column as aforesaid, said front display face being formed with a dispensing opening for rolls of decorative sheet material adjacent the lower end of said storage rack whereby the bottom roll of said column can be withdrawn from said column, said storage rack terminating in a support ledge adjacent said dispensing opening, said body being formed with a filling opening for admitting rolls of decorative sheet material to said storage rack, said front display face having a vertical extent substantially coextensive with the vertical height of said storage rack and a horizontal extent substantially coextensive with the lateral extent of said storage rack whereby said front display face can display a substantial length of the decorative sheet material of the rolls of decorative sheet material in a column in said rack.

3 Claims, 10 Drawing Figures

DISPENSING AND DISPLAY DEVICE

This invention relates to a device for stocking and displaying rolls of decorative material such as wall paper in a retail outlet.

The display and stocking of wall paper in retail outlets has, for many years, been the most difficult aspect of retailing these products. A common manner of doing it in a well stocked store is to stock the wall paper rolls on racks, one for each different pattern, to identify the pattern rolls by a number, and to display a length of each pattern from a roll in a pattern book. With this method the customer thumbs the pages of the book to make his selection as to pattern, notes the number and picks up his wall paper from the rack by number.

The system is cumbersome because customers in the store can look at the book one only at a time. Books are expensive to compile because they must each include a sample of each kind of wall covering in stock. They are, moreover, bulky and because of the expense and the bulk few stores have enough books to satisfy customer demand especially at peak periods of business.

The display and storage unit of this invention avoids the use of cumbersome pattern books and displays a practical sample of each wall covering immediately adjacent a conveniently stored supply thereof. Customers in the store are able to view a large number of wall coverings in a vertical display position similar to the position they will occupy on a wall by merely casting their eyes about the store and walking from one display device to another. Many persons can examine one or other of the patterns at the same time.

A display and storage device for rolls of decorative sheet material according to this invention comprises a body, a storage rack in said body adapted to support a single file column of rolls of decorative sheet material with their roll axes parallel and horizontal, said body having a front display face that substantially conceals said storage rack, said rack having a depth greater than the depth but less than twice the depth of a roll of decorative material to be contained thereby whereby to support said rolls in a single file column as aforesaid, said front display face being formed with a dispensing opening for rolls of decorative sheet material adjacent the lower end of said storage rack whereby the bottom roll of said column can be withdrawn from said column, said storage rack terminating in a support ledge adjacent said dispensing opening, said body being formed with a filling opening for admitting rolls of decorative sheet material to said storage rack, said front display face having a vertical extent substantially coextensive with the vertical height of said storage rack and a horizontal extent substantially coextensive with the lateral extent of said storage rack whereby said front display face can display a substantial length of the decorative sheet material of the rolls of decorative sheet material in a column in said rack.

The invention will be clearly understood after reference to the following detailed specification read in conjunction with the drawings.

Figure 1:
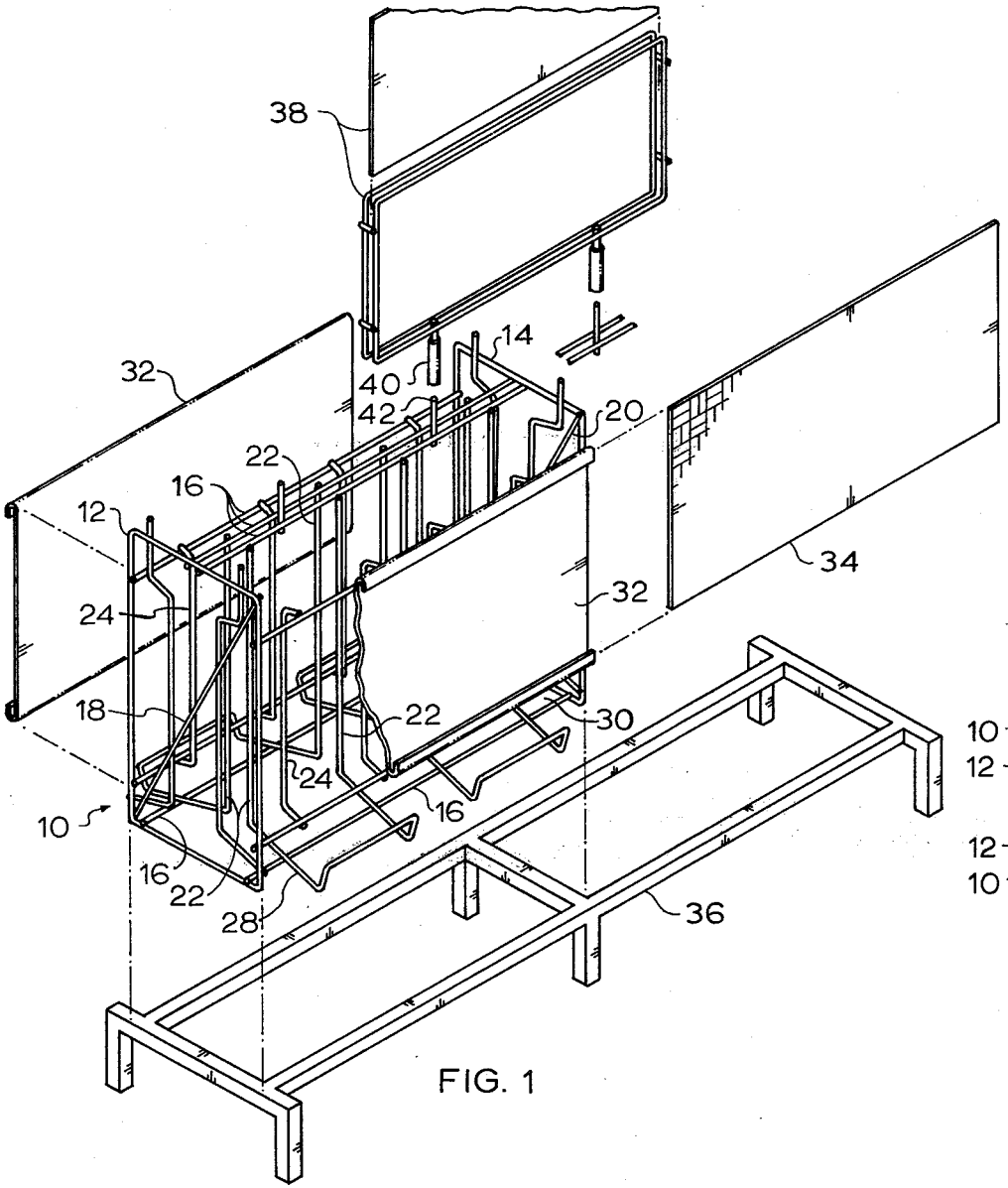
FIG. 1 is an exploded view of one display container and a floor stand therefor.
Figure 7:
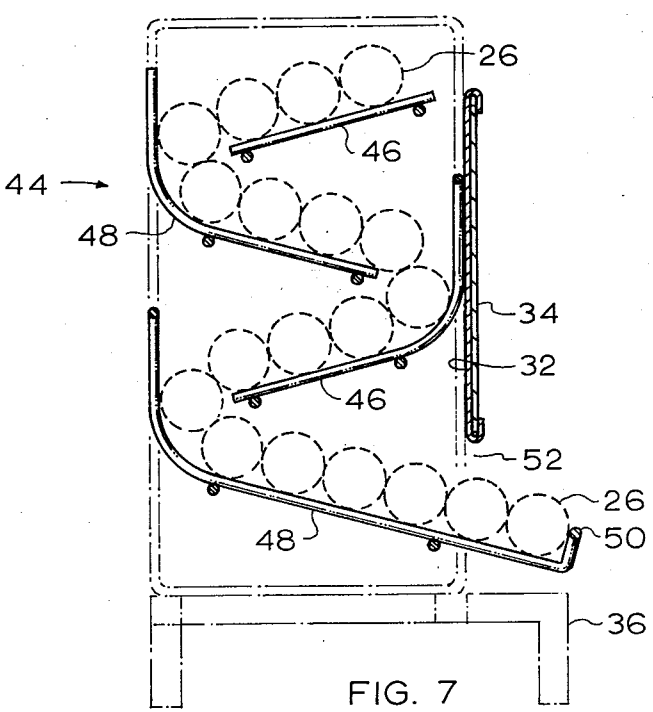
FIG. 7 is a vertical sectional view of the display container of FIG. 4 illustrating only the storage racks, filling opening, dispensing opening and display face, the stand and end of the display container being illustrated in broken lines.
Figure 4:
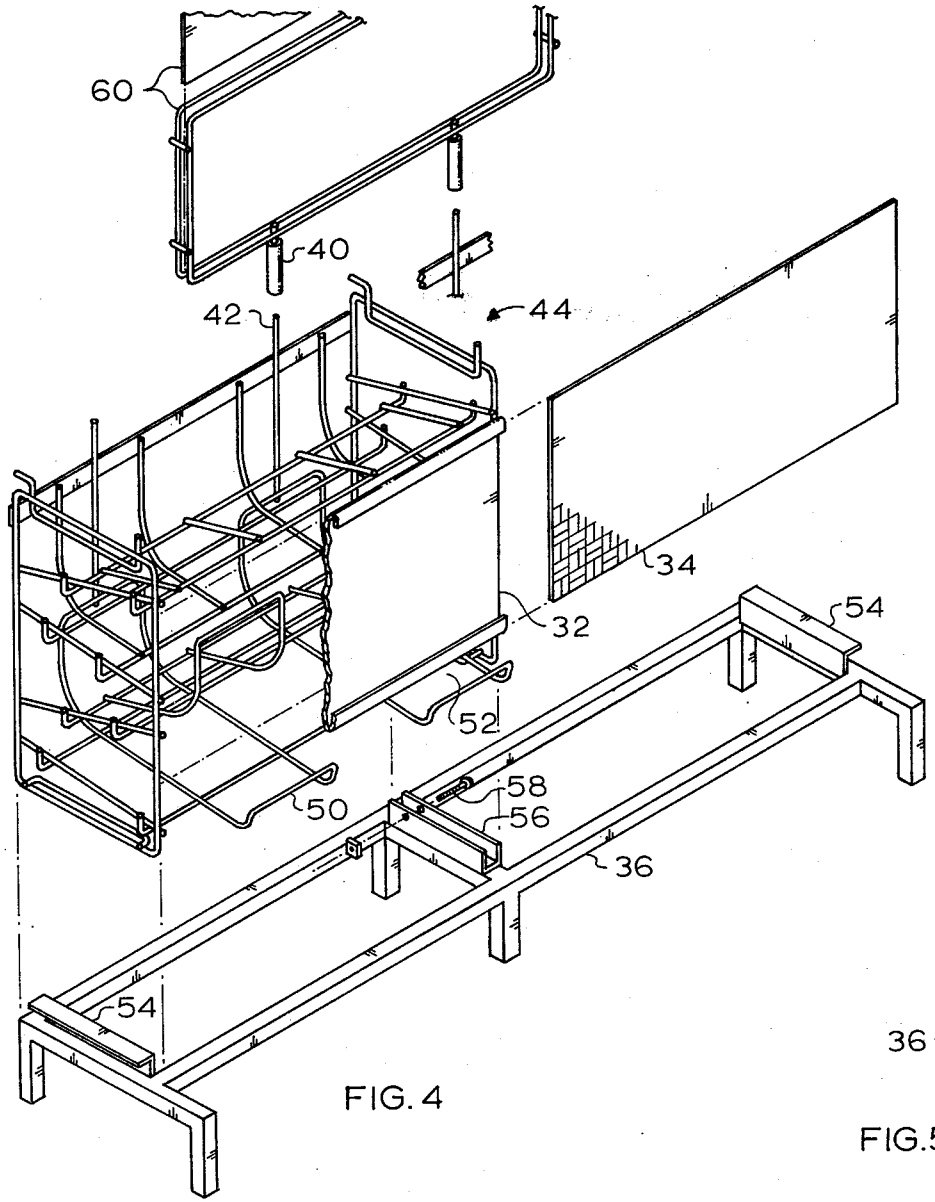
FIG. 4 is an exploded view of a display container on a floor stand therefor, the storage rack being of a different design to the storage rack in the container of FIG. 1.
Figure 10:
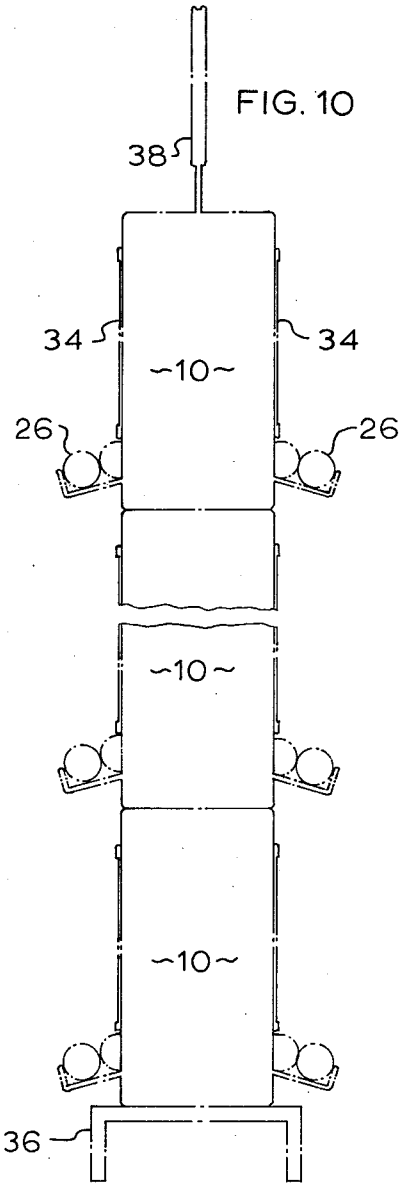
Figure 9:
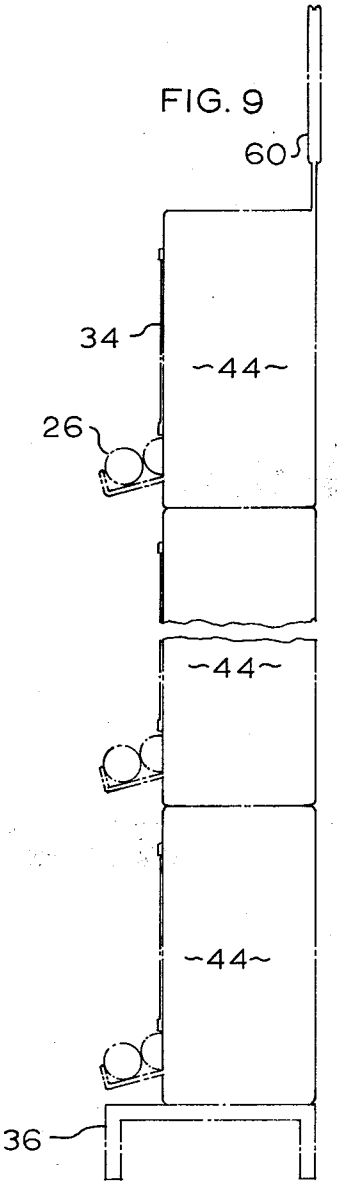
Figure 8:
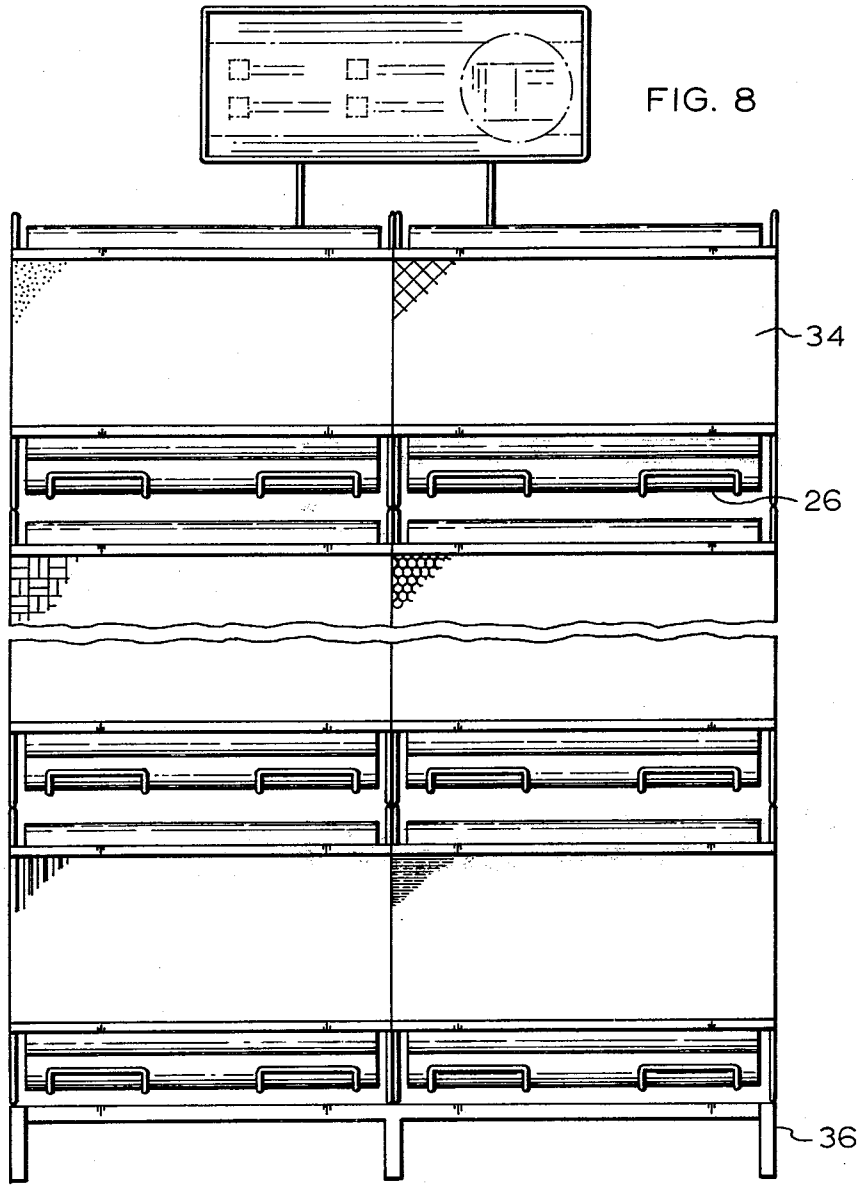

FIG. 8 is a front view of a group of containers stacked in side by side relation on a stand, the front elevation of a group of stacked containers of the type illustrated in FIG. 1 being the same as the type illustrated in FIG. 4; and FIGS. 9 and 10 are end view outline illustrations of stacked containers, FIG. 9 being containers of the type illustrated in FIG. 4 and FIG. 10 being containers of the type illustrated in FIG. 1.

Referring to the drawings, the numeral 10 generally refers to a display container for a quantity of rolls of wall paper. The body of the display container is fabricated from wire and has wire end structures 12 and 14 rigidified by means of a plurality of transversely extending supports 16 and cross supports 18 and 20.

The display container has a storage rack defined by a series of vertically extending wires 22 and a series of vertically extending wires 24 adapted to support a single file column of rolls of wall paper 26. The racks, as stated, are adapted to support a single file column of rolls and, in this respect, they have a depth greater than the depth of a roll of wall paper but less than twice the depth of a roll of wall paper so that they do support the rolls in a single file column.

The wires 22 at their lower ends merge with a forwardly extending wire section 28 that extends beyond the front face of the container and through dispensing opening 30 whereby a roll 26 of wall paper can be withdrawn from the bottom of the stack. It will be noted that the forwardly extending portions 28 of adjacent wires 22 are looped to form a retaining ledge for the stack of rolls in the container.

A display panel 32 is mounted on each face of the container by means of the transversely extending wires as illustrated in FIG. 1. Panels 32 have rolled over edges to slidably receive a board 34 pasted with a specimen of the design of the rolls of wall paper in the storage rack behind the panel. The panel 32 and the board 34 are substantially the same width as the wall paper roll so that the wall paper displayed is a piece the full width of the roll and is in a vertical position.

In use display containers 10 are stacked in side by side relation on a stand 36 as illustrated in FIG. 10 and each of the storage racks is filled with wall paper the design of which is displayed on the display panel in front of each rack. Thus, each rack has a different design wall paper and the design of each is prominantly displayed in a vertical position on the display panel for each rack. An advertising board 38 can be mounted on the top container by sliding tubular posts 40 over the prongs 42.

Figure 3:
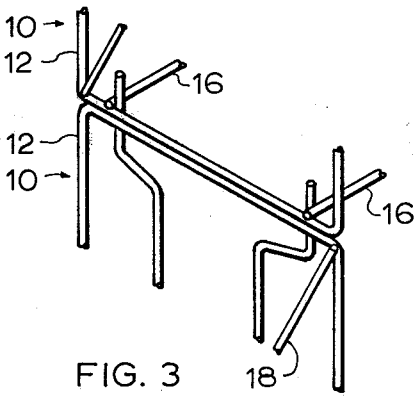
FIG. 3 is a detail illustrating the manner in which the ends of the display containers interlock when they are stacked one above the other.

The display containers 10 rest directly on the base 36. FIG. 3 illustrates the manner in which adjacent stacked containers interlock with each other. It will be noted that the end formations 12 and 14 have an upwardly extending wire section that interlocks with the end portions of the container above and its laterally extending supports 16.

Figure 2:
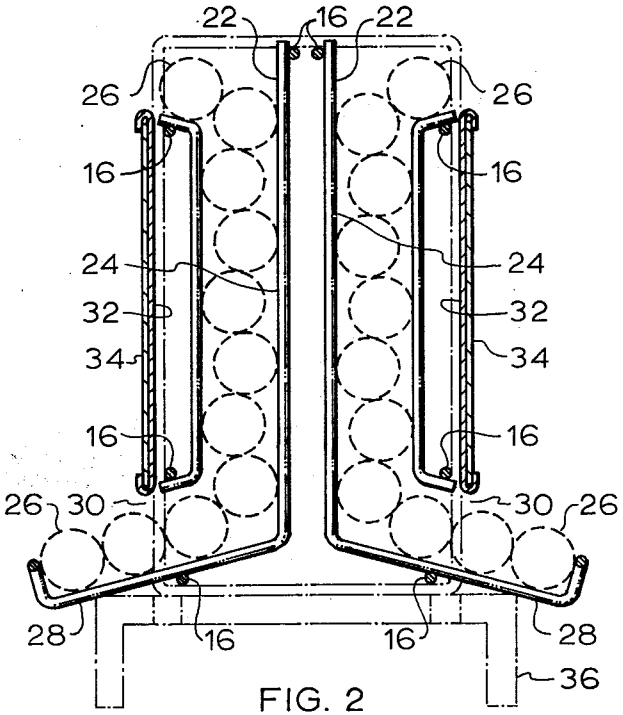
FIG. 2 is a vertical sectional view of the display container of FIG. 1 illustrating the storage racks, filling opening, dispensing opening and display face, the stands and the end of the display container being illustrated in broken lines.

FIG. 4 illustrates a display container of a different type. In this case, the storage rack is not as vertical as in the case of the storage containers of FIG. 1. Rather it is in a zig-zag form. The containers of FIG. 4 generally indicated by the numeral 44 have a storage rack defined by a plurality of wires that extend longitudinally of the storage container in spaced apart relation and that are arranged in pairs, the wires 46 and 48 of each pair each sloping downwardly but in opposed directions transversely of the storage container, the wire 46 being above the wire 48 and adapted to discharge rolls from its lower end to the upper end of the next following wire 48 in its pair. By arranging the wires 46 and 48 in this manner the rolls of paper 26 are stored in a zig-zag fashion. This method of storage is particularly important where the rolls 26 are rolls of a compressible wall paper. Wall papers that are flocked, for example, are compressible and if stored in a high vertical column such as illustrated in FIG. 2 of the drawings for an extensive period of time they compress and the flocking is spoiled. By arranging the storage compartment in zig-zag fashion one avoids the weight of a long column of rolls on the bottom roll and thereby avoids damage to wall papers of a compressible nature.

The bottom wires 48 are extended and pairs of them are looped as at 50 to form a dispensing trough at the dispensing opening 52 of the container.

Containers 44 have a display panel 32 on the front wall thereof which is adapted to receive a display card 34 in a similar manner to the containers 10. However, because of the zig-zag fashion of the storage compartment they are deeper and cannot accommodate two stacks between their front and back face. They are similarly stacked on a stand and from one side their appearance is the same as the containers 10. However, they have a flat back with no dispensing openings and containers of this type would normally be stored against a wall of a retail outlet. FIG. 9 is an illustration of a series of stacked containers similar to the container 44.

Figure 6:
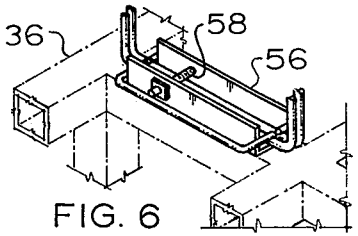
FIGS. 5 and 6 are detailed illustrations of the manner in which the ends of the display containers of FIG. 4 interlock when they are stacked one above the other.
Figure 5:
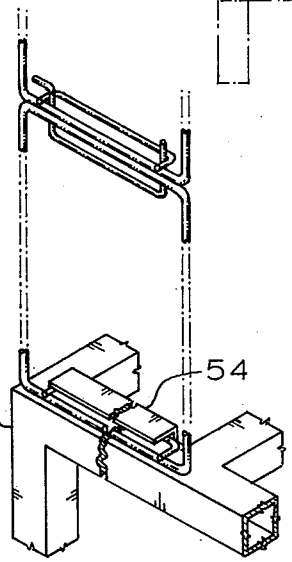

FIGS. 5 and 6 illustrate the manner of securing these containers to a stand. In this particular case the stand 36 has a channel section 54 at its ends which is designed to interlock with the bottom of the end portion of a container as illustrated in FIG. 5. The other ends of the containers fit into a channel 56 as illustrated in FIG. 6 and are secured thereto by means of a bolt 58. The interlocking of stacked containers at their upper ends is illustrated in FIG. 5. It will be noted that there is a variation in the design from that of the type of container of FIG. 1 as illustrated in FIG. 3. These matters, however, are mere modifications not thought to be relevant to the inventive concept.

Containers 44 can be made to accept an advertising card 60 in a similar manner to container 10.

Embodiments of the invention other than the ones illustrated will be apparent to those skilled in the art.

What I claim as my invention is:

1. A display and storage device for rolls of decorative sheet material comprising a body having a series of storage racks each adapted to support a single file column of rolls of decorative sheet material with their roll axes parallel and horizontal;

a front display face on said body for each of said storage racks that substantially conceals its respective storage rack and has a width substantially equal to the width of its storage rack;

said storage racks being arranged one above the other and the front display faces of said storage racks being in a substantially common vertical plane;

said racks each having a depth greater than the depth but less than twice the depth of a roll of decorative material to be contained thereby whereby to support said rolls in a single file comumn as aforesaid;

said front display face being formed with a dispensing opening for rolls of decorative sheet material adjacent the lower end of said storage rack whereby the bottom roll of said column can be withdrawn from said column;

said storage racks each terminating in a support ledge adjacent said dispensing opening;

said body being formed with a filling opening for admitting rolls of decorative sheet material to said storage rack;

similar rolls of decorative material being loadable in each of said storge racks;

said front display faces having a vertical extent substantially coextensive with the vertical height of their respective storage rack and a horizontal extent substantially coextensive with the lateral extent of their respective storage rack whereby said front display faces can display the full width of a substantial length of the decorative sheet material of the rolls of decorative sheet material in a column in their respective rack.

2. In a display and storage device for rolls of decorative sheet material as claimed in claim 1 wherein said body has a series of said storage racks arranged one above the other whereby their respective front display faces are in a substantially common vertical plane.

3. In a display and storage device for rolls of decorative sheet material as claimed in claim 2 wherein said body has more than one of said series of storage racks the front display faces of each series being in a common plane with the front display faces of at least one other series.

* * * * *